US005369935A

United States Patent [19]

Lang et al.

[11] Patent Number: 5,369,935

[45] Date of Patent: Dec. 6, 1994

[54] PROCESS AND DEVICE FOR WRAPPING A COVER FILM AROUND A PRESSED BALE

[75] Inventors: Jürgen Lang, Gessertschausen; Herwig Hirschek, Bobingen, both of Germany

[73] Assignee: Autefa Maschinenfabik GmbH, Friedberg, Germany

[21] Appl. No.: 949,833

[22] PCT Filed: May 14, 1991

[86] PCT No.: PCT/EP91/00902

§ 371 Date: Nov. 9, 1992

§ 102(e) Date: Nov. 9, 1992

[87] PCT Pub. No.: WO91/17922

PCT Pub. Date: Nov. 28, 1991

[30] Foreign Application Priority Data

May 15, 1990 [DE] Germany ..... 4015642

[51] Int. Cl.[5] ..... B65B 11/02; B65B 11/58; B65B 27/12; B65B 49/06

[52] U.S. Cl. ..... 53/399; 53/176; 53/449; 53/586

[58] Field of Search ..... 53/176, 589, 210, 222, 53/223, 224, 225, 580, 397, 399, 449, 528, 464, 465, 586

[56] References Cited

U.S. PATENT DOCUMENTS

| | | | |
|---|---|---|---|
| T893,007 | 12/1971 | McCormick | 53/449 |
| 1,162,611 | 11/1915 | Jones | 53/225 X |
| 2,265,636 | 12/1941 | Eaton | 53/222 X |
| 2,858,657 | 11/1958 | Guthrie . | |
| 2,937,484 | 5/1960 | Wiman | 53/580 X |
| 3,816,970 | 6/1974 | VanDoorn et al. . | |
| 3,893,279 | 7/1975 | Bostrom | 53/176 X |
| 3,962,846 | 6/1976 | Neitzel et al. . | |
| 5,131,210 | 7/1992 | Kiya | 53/399 |

FOREIGN PATENT DOCUMENTS

| | | |
|---|---|---|
| 0294820B1 | 6/1988 | European Pat. Off. . |
| 2911958 | 10/1980 | Germany . |
| 0075162 | 3/1983 | Germany . |

*Primary Examiner*—Linda B. Johnson
*Attorney, Agent, or Firm*—McGlew and Tuttle

[57] ABSTRACT

The present invention pertains to a process and a device for wrapping a cover film (6, 7) around a pressed bale (4) on a baling press (1), wherein the cover film (5, 6) stretched between the pressure ram (2, 3) and the pressed bale (4) is placed on the lateral surfaces of the pressed bale (4). A laterally projecting fold is formed in the cover film (6, 7) in the corner areas via a folding frame (10), and this fold is subsequently folded over and placed on the pressed bale (4). The vertically movable folding frame (10) may be designed as a stripping frame (14), or it may consist of a plurality of multiaxially movable rakes (11). Figure selected: FIG. 3.

15 Claims, 7 Drawing Sheets

PROCESS AND DEVICE FOR WRAPPING A COVER FILM AROUND A PRESSED BALE

FIELD OF THE INVENTION

The present invention pertains to a process and a device.

BACKGROUND OF THE INVENTION

It has been known in practice that the cover films, which are stretched above and below between the pressed bale and the pressure rams, are wrapped by pins and placed on the lateral surfaces of the pressed bale after the press box has been pulled off. If desired, a belly band is placed around the bale, and the package is finally fixed by straps. The relatively inaccurate wrapping with the cover film has proved to be disadvantageous in practice, because the usually rectangular cover film, which projects beyond the base of the bale on all sides, is crumpled in the corners in an undefined manner, and it may become detached, despite strapping, when the pressed bale expands after releasing the pressure exerted by the pressure rams or later, during storage. As a result, the bale package may open, as a consequence of which the pressed bale will be exposed to environmental effects, such as soiling, rain water, etc., in an undesired manner.

SUMMARY AND OBJECTS OF THE INVENTION

It is therefore the task of the present invention to provide a process and a device for reliably and durably wrapping a cover film around a pressed bale.

According to the present invention, a defined fold is formed in the corner zones of the cover film when the cover film is placed on the lateral surfaces of the pressed bale, and this fold is subsequently folded over with a likewise defined movement, and is placed on the pressed bale or the lateral film web already placed around the bale. The entire cover film is thus wrapped around the head area of the pressed bale as a flat envelope in contact with the bale. Due to the defined shaping and end position of the fold in the corner zone, the fold cannot become loose later. The package remains tight, and the pressed bale is protected. In addition, one strapping device is sufficient. Crosswise strapping is not necessary.

The fold can be formed and folded over in the same manner with the upper as well as the lower cover film. The fold is preferably folded over toward the broad side of the pressed bale, because it is fixed directly there by the strapping, which is usually placed around the broad sides. Due to the strapping and the accurate fold formation, the upper edge of the bale, which sometimes tends to bulge out after removal of the pressure ram, is held down better as well. The fold is stretched down by a counteracting force, which is directed downward and inward, counteracts bulging out, and fixes the edge of the bale.

To secure the fold position until strapping, the fold is temporarily held by a folding finger. If the straps or other bale fixing means are placed in another manner rather than over the broad sides of the bale in the case of different packing techniques, the fold is shaped and folded over in a correspondingly different manner, so that it will ultimately be held by the final bale fixing means in the same manner.

The folds are formed by a movable folding frame, which may have different shapes and be moved in different manners. In one of the two preferred embodiments, the folding frame is designed as a rigid stripping frame with stripping openings made in one piece with it for the folds. This embodiment is particularly suitable for the lower cover film, because the stripping frame can be connected to the press box and can be pulled off. As a result, the cover film is also folded and wrapped around along with the pulling off of the box. This makes it possible to eliminate the need for a separate drive for the folding frame. However, the stripping frame can also be used to wrap around the upper cover film. In this case, it is a multiple-part that is movable in itself in order to provide place for the box pulled off and to subsequently close it again around the pressed bale for the folding function.

The second variant provides for a multipart folding frame, which consists of a plurality of rakes, which are movable around a plurality of axes and are able to perform a horizontal movement and a vertical movement in the preferred embodiment. This design is preferable for wrapping over the upper cover film, but it is also suitable for the lower cover film. The folds are formed here by the vertical lowering movement and the horizontal feeding movement of the rakes. The folding fingers for folding over the folds are parts of the rakes here and are also able to support fold formation during feeding by an additional transverse movement.

The above-mentioned distinctions between a lower cover film and an upper cover film are based on the assumption of an overhead baling press, in which the lower pressure ram is stationary, while the upper one is held and driven movably. The press box is also pulled off in the upward direction. The associations and the preferred fields of application of the folding device change correspondingly in baling presses of different design.

Both embodiments of the folding frame are suitable for different bale sizes and bale materials. The machine operators sometimes deliberately produce different bale sizes. In addition, different bale materials expand to different extents on release. The differences may reach up to 150 mm or more. In prior-art packing devices, this often leads to problems in terms of adjustment. This is not true in the case of the embodiments according to the present invention. In addition, adjustment takes place automatically. It is also advantageous that, despite the different bale sizes, the cover films will not be impaled on the rake, the pins, or the folding fingers, which would be undesirable. As a result, damage to the films or parts of the device, as well as malfunctions are avoided.

The process according to the present invention and the corresponding device are particularly suitable for use on carrousel baling presses, in which packing is performed within the baling press. As an alternative, the process and the device may also be used in other designs, e.g., with external packing stations, in which the pressed bales are moved from the press into the packing station with the pressure rams placed against them.

The process according to the present invention and the corresponding device have a low manufacturing cost and are particularly economical. It is also possible to retrofit existing baling presses or packing stations with the device according to the present invention, or existing wrapping devices can be replaced with it.

BRIEF DESCRIPTION OF THE DRAWINGS

The present invention is represented as an example in the drawings and is schematically described in two exemplary embodiments. Specifically.

DETAILED DESCRIPTION OF THE PREFERRED EMBODIMENT

Figure 1:
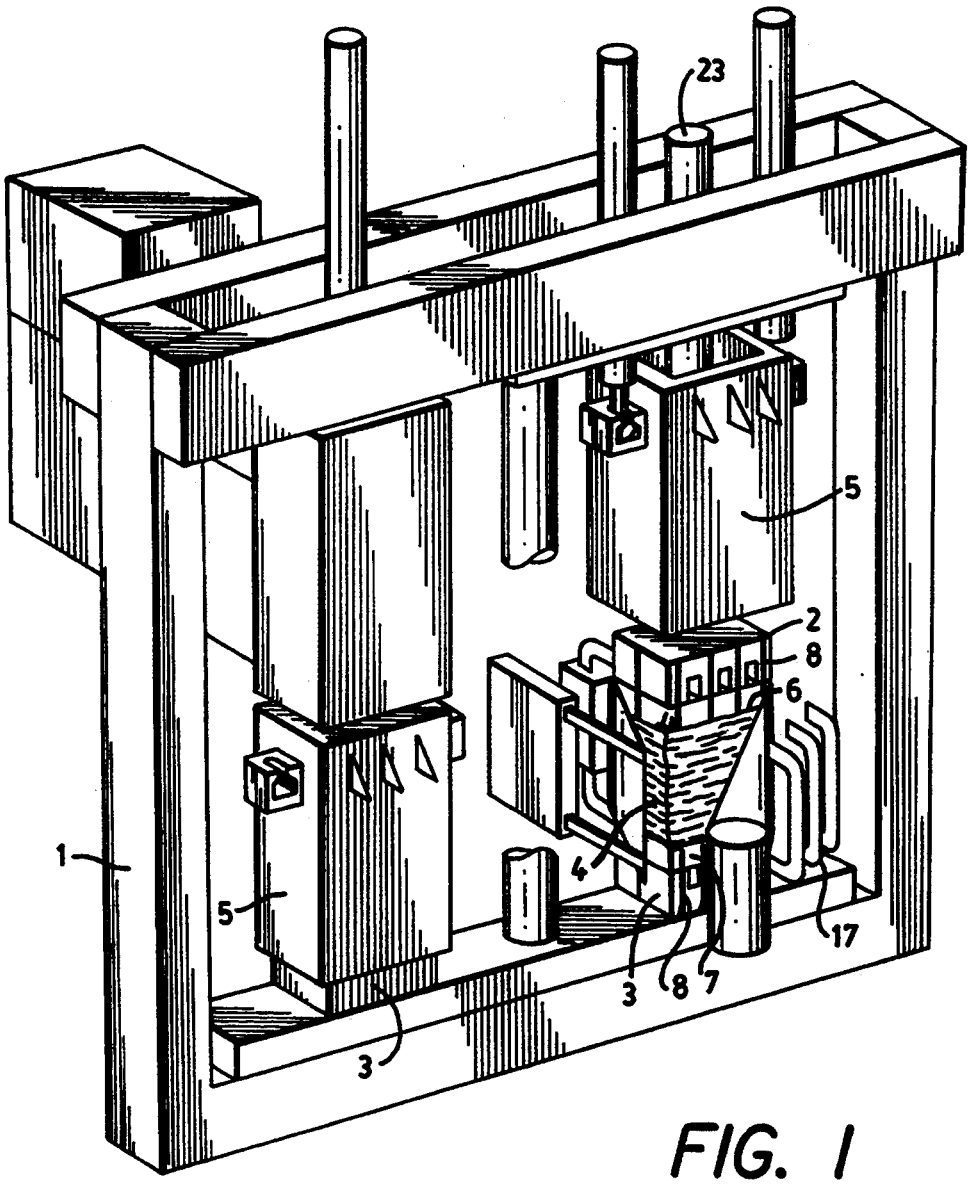
FIG. 1 shows a perspective view of a carrousel baling press with device for wrapping over the cover films.

FIG. 1 shows a baling press (1) in the form of a carrousel baling press with two stations. In one of them, the lowered press box (5) is filled with fibrous material, tow or other flowable and pressable materials, prepressed if desired, and then turned into the next station. The final pressing and packing of the pressed bale (4) take place here. In the baling press shown, the lower pressure rams (3) are arranged on a yoke beam and are able to rotate in it only in the horizontal plane, but they are unable to perform lifting and lowering movements. For pressing the bale, the said upper pressure ram (2) is moved up and down by the piston rod (23) of a hydraulic drive (not shown).

After final pressing, the bale (4), which is still under pressing pressure, is packed. To do so, the said press box (5) is pulled off in the upward direction via a suitable lifting device. Before a said press box (5) is filled, a cover sheet (7) each is placed over the said lower pressure ram (3), and secured. The lower cover film will hereinafter be called the bottom film (7). The upper cover film (6), hereinafter called the head film, is placed onto the material pressed in the said press box (5) prior to the final pressing, and is carried by the said lowered upper pressure ram (2).

The said head film (6) and the said bottom film (7) are wrapped around the said pressed bale (4) in the manner described below, and they lie tightly on the said bale like a cap. A belly band or middle film, which overlaps the said cover films (6, 7) wrapped around, is subsequently placed around the said pressed bale (4). Finally, the films are fixed by a hoop-casing device (17); a single strap over the broad side (19) of the said pressed bale (4) is sufficient.

Figure 6:
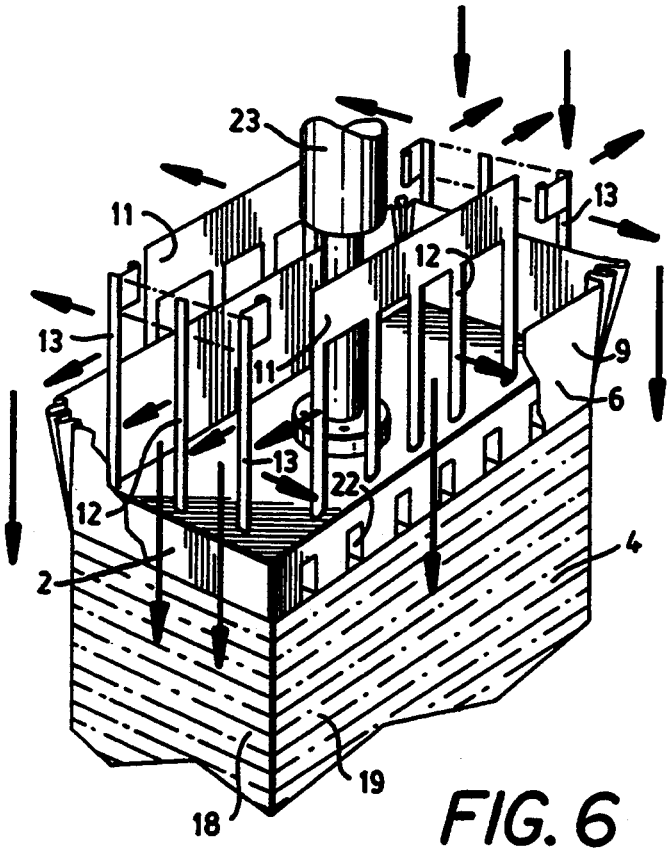
Figure 7:
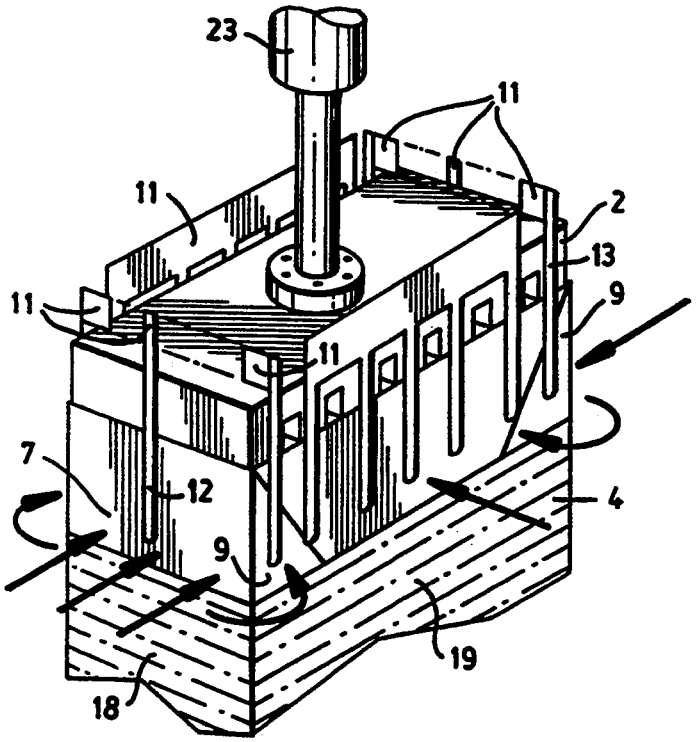

Folding devices (8), one of which is associated with the said upper pressure ram (2) and another with the said lower pressure ram (3), are used to wrap the said cover films (6, 7) around the head area and the foot area of the said pressed bale (4), respectively. Two embodiments of the said folding device (8) are represented; of these, FIGS. 2 through 5 show the variant for the said bottom film (7), and FIGS. 6 and 7 show the variant for the said head film (6). The two embodiments can be interchanged in the case of a corresponding change in design. As an alternative, it is also possible to use two identical units of only one variant.

As is illustrated in FIGS. 2 through 5, one said folding device (8) is formed of a vertically movable stripping frame (14), which is connected, in the embodiment shown, to the bottom side of the said press box (5) via suitable supports, and is raised and lowered with the press box 5. To ensure this, it the stripping frame 14 is preferably located at a closely spaced location below the lower edge of the box. As a result, the said pressed bale (4) can stretch only insignificantly at most when the box is being pulled off and the said stripping frame is moved over it. Thus, the said stripping frame fits different bale sizes and bale materials. Four folding fingers (13) also belong to the said folding device (8).

Figure 5:
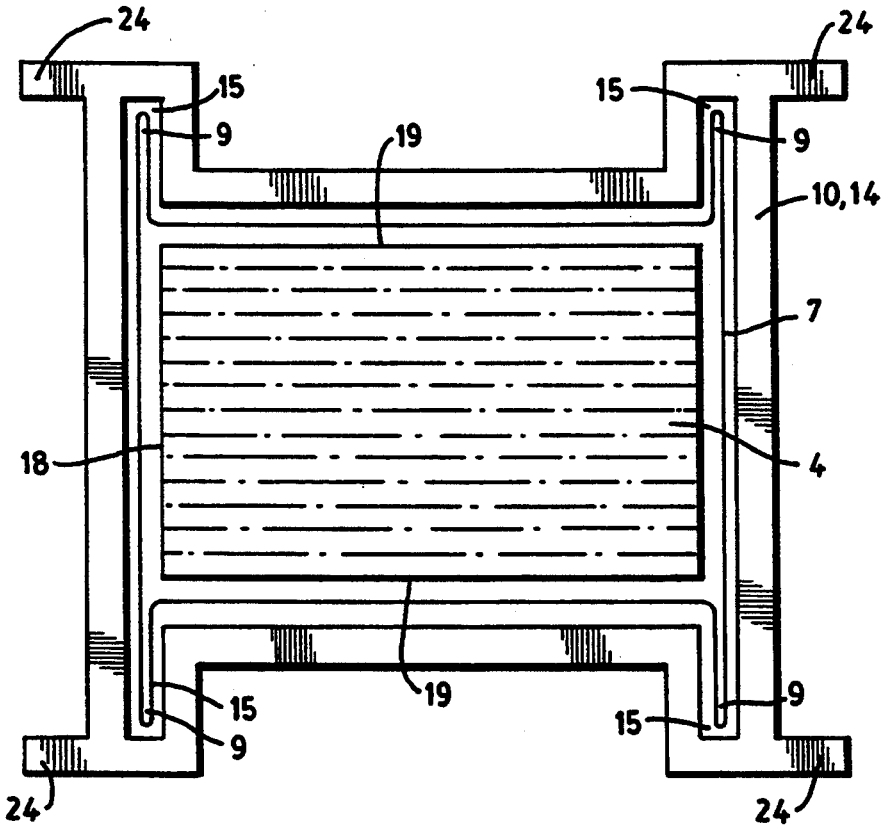
FIG. 5 shows a top view of the folding frame corresponding to the arrow V in FIG. 3, FIGS. 6 and 7 show the second embodiment with a movable folding frame in two movement positions and in a perspective view.

FIG. 5 illustrates a top view of the said stripping frame (14). The said stripping frame (14) has the shape of an I and surrounds the said pressed bale (4) on the side. There is a certain distance between it the said stripping frame 14 and the lateral surfaces of the said pressed bale (4) in order to provide space for the said bottom film (7). The free I-shaped inner surface of the said stripping frame (14) consists of an essentially rectangular base corresponding to the shape of the bale and of four stripping openings (15) arranged in the corner areas. These stripping openings 15 extend laterally and in the extension of the narrow sides (18) of the said pressed bale (4) in the outward direction. They have the task of forming a laterally projecting, defined fold (9) in the corners of the said bottom film (7).

Figure 2:
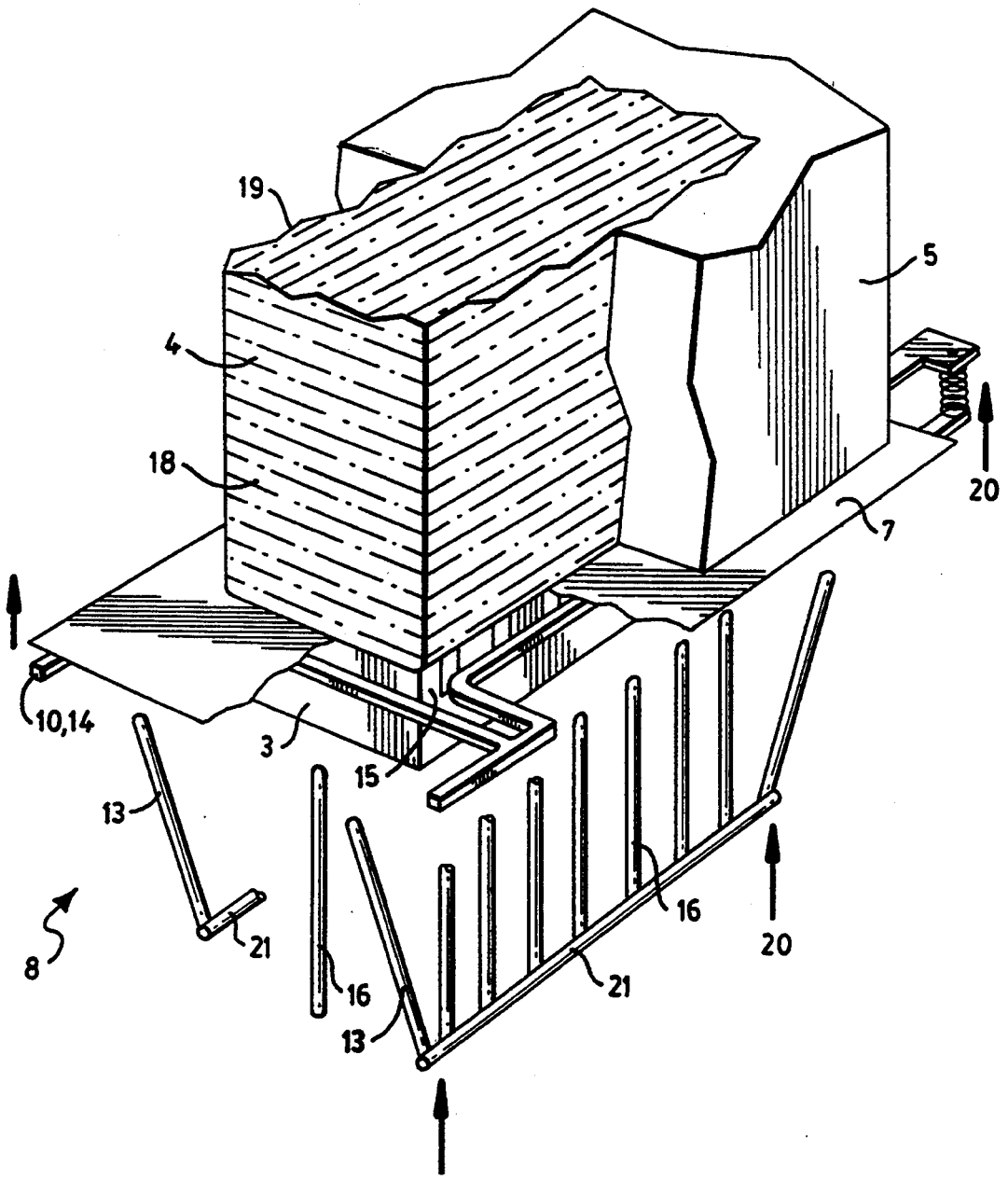
FIGS. 2–4 show a perspective view of an embodiment with a rigid folding frame in three positions.
Figure 3:
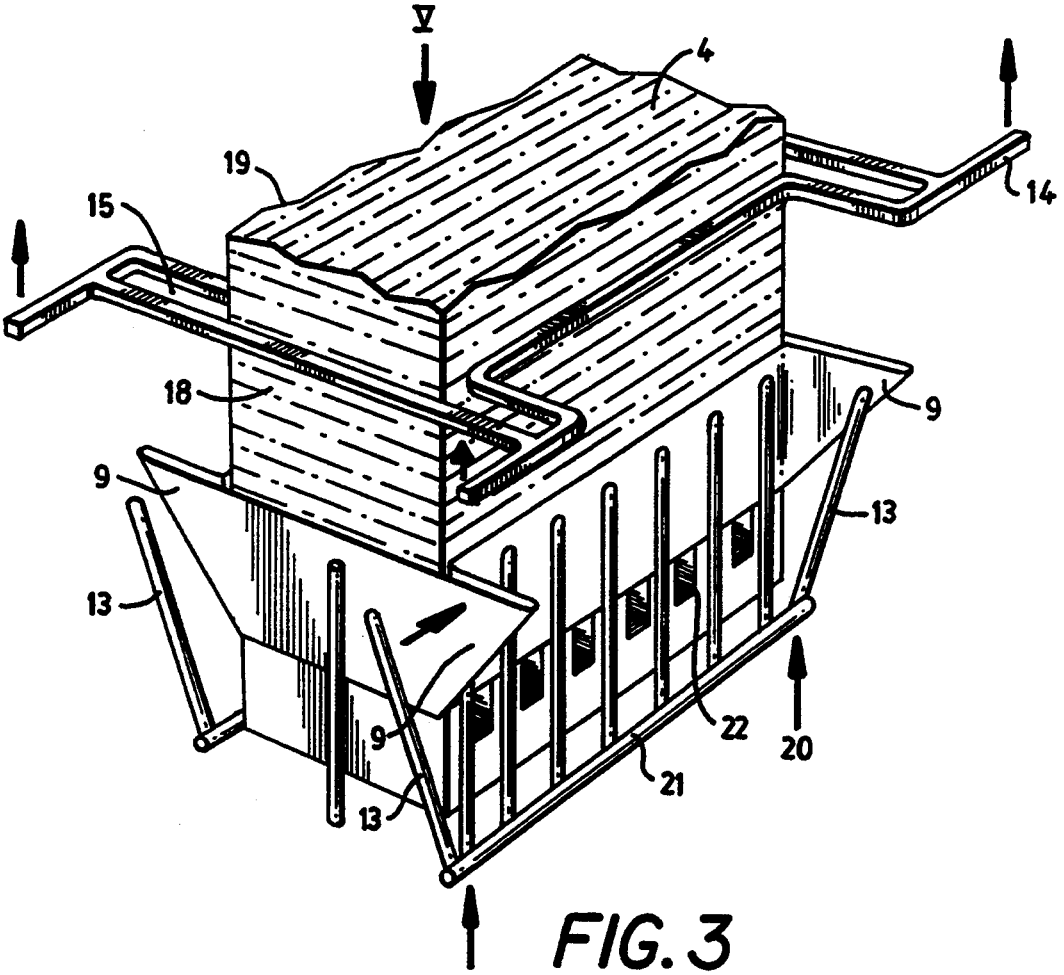
Figure 4:
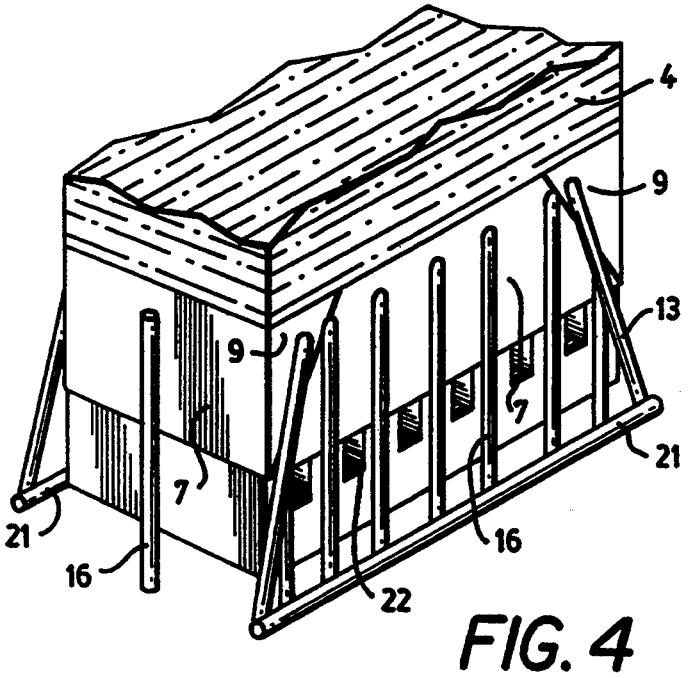

During the final pressing of the said bale (4), the said stripping frame (14) is located at the level of or below the said lower pressure ram (3). FIG. 2 shows a position after completion of the pressing process, in which the said press box (5) with the said stripping frame (14) has already been raised somewhat in the direction of movement (20). The said stripping frame (14) now grips under the said bottom film (7) hanging down from the said pressure ram (3) and raises it. The said bottom film (7) now lies flatly, as shown in FIG. 2, on the lateral projections and shoulders (24) of the said frame. With the lifting movement of the said stripping frame (14), the said bottom film (7) is placed over the lateral surfaces of the said pressed bale (4), and a fold (9) each is formed in the said stripping openings (15) at the same time. FIG. 3 shows the stripping position, in which the said bottom film (7) has left the said stripping frame (14) and lies, with projecting folds (9), in contact with the said pressed bale (4).

To secure the said bottom film (7) placed over the bale 4, a plurality of height-adjustable pins (16) are arranged distributed around the said pressure ram (3). On the said two broad sides (19), the said pins (16) are positioned staggered with the strapping grooves (22) in the said pressure ram (3), which said grooves open there. The said pins (16) are also raised with the said proceeding stripping frame (14), and they press the said cover film (7), which has already been stripped out and placed over, against the said pressed bale (4).

At least on the said two broad sides (19), the said pins (16) are arranged together on a lifting bar (21), which carries, at its ends, an obliquely outwardly directed folding finger (13) each. The said pins (16) may still be missing on the narrow sides (18) of the said pressed bale (4).

As soon as the said bottom film (7) has been stripped out and placed over according to. FIG. 3, the said folding fingers (13) come into action. They are located approximately at the level of the said broad sides (19) of the said bale (4), but they are outside the said folds (9)

due to their oblique position. From the position shown in FIG. 3, they pivot inward along an axis extending along the said narrow sides (18), and fold the said fold (9) associated with them onto the said broad side (19) of the said pressed bale (4). The said actually adjacent pins (16) can now act as a holder. The said fold (9), folded over, comes to lie on the said pins (16) or the film web already placed on. It is held in this position by its swung-in folding finger (13). The said bottom film (7) is placed tautly around the said pressed bale (4), and it fits tightly due to the said defined folds (9).

Figure 8:
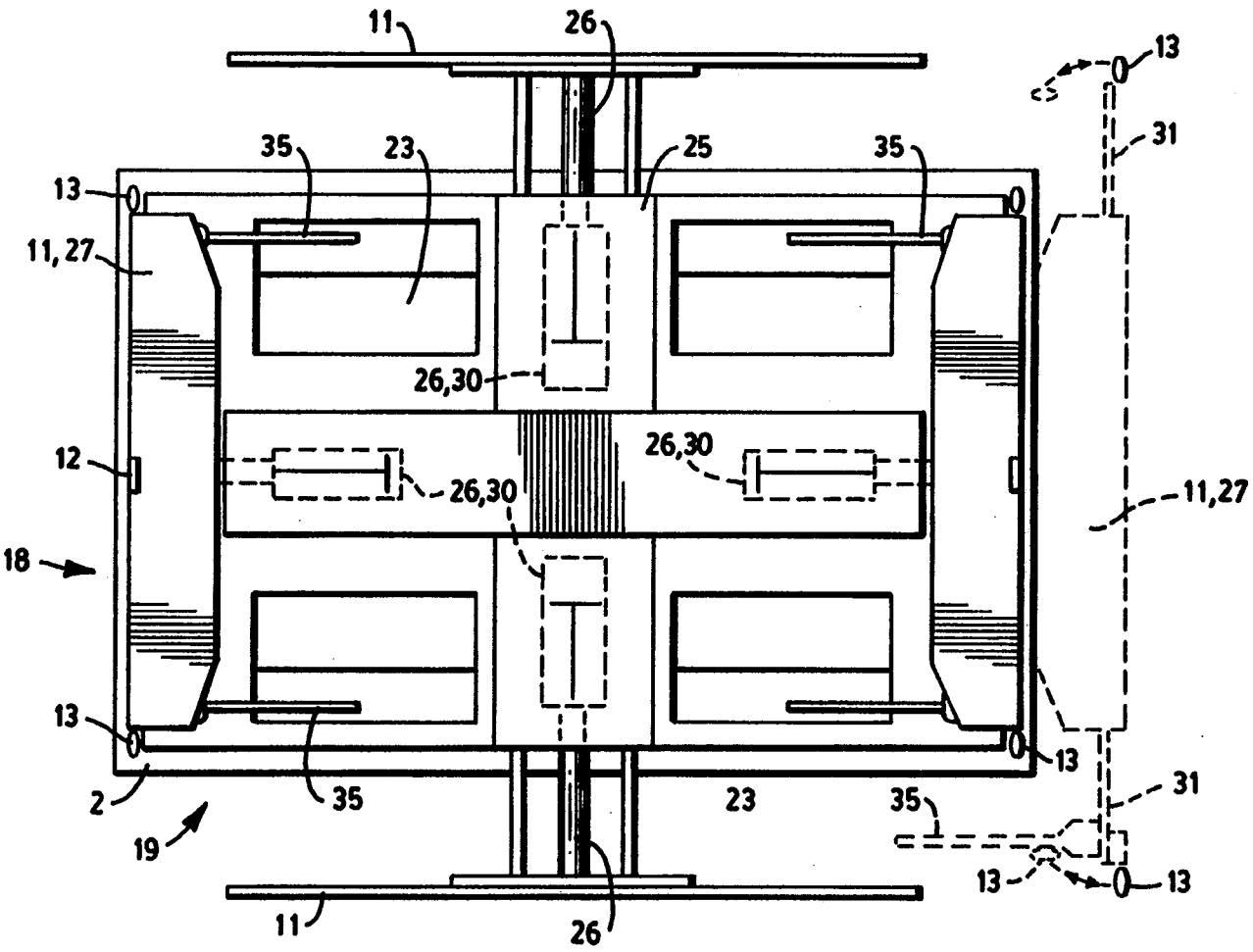
FIG. 8 shows a simplified top view of the lifting drives for the folding frame according to FIGS. 6 and 7, and FIGS. 9 and 10 show the arrangement of the lifting drives according to FIG. 8 in an enlarged and cutaway detail top view and in two positions.
Figure 9:
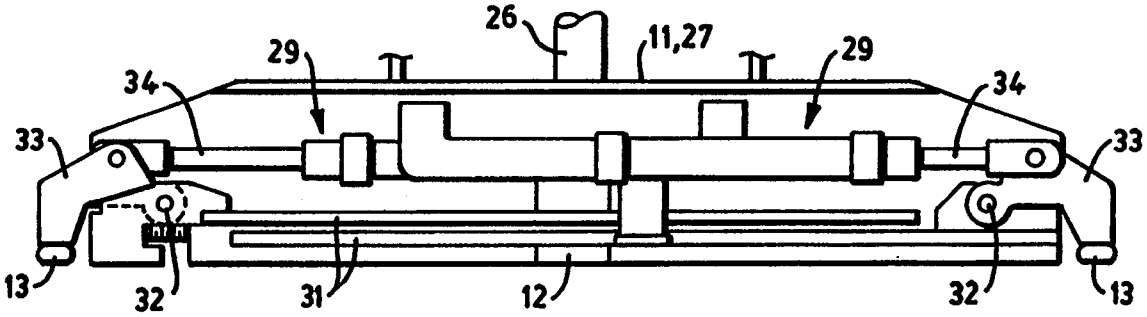
Figure 10:
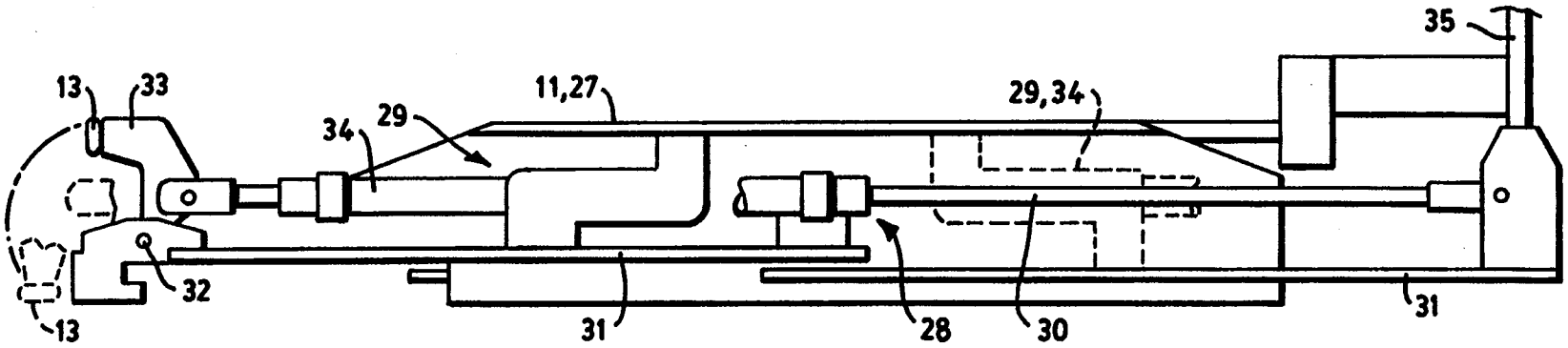

The said second folding device (8) according to FIGS. 6 through 9 is used to wrap around the said head film (6). The said folding frame (10) is a multisectional frame here, and is movable in itself. It consists of four rakes (11) with downwardly projecting tines (12), which are staggered, like the said pins (16), in relation to the said strapping grooves (22). The said four rakes (11) are arranged distributed over the four sides of the pressure ram, and are moved via pushing and lowering drives. For clarity's sake, FIGS. 8 through 10 show only the said pushing drives (26), which impart a horizontal movement to the said rakes (11). The movements of the rakes are symbolized by arrows.

The said pushing drives (26) with the said rakes (12) are seated in a frame (25) on the said upper pressure ram (2). The said pushing drives (26) consist of cylinders (30) and guides for the horizontal movement of the said individual rakes (12). A common drive, e.g., with a two-sided cylinder, may also be provided for said rakes (26) which are located opposite each other. In the resting position, the said rakes (11) are retracted behind the edge of the said pressure ram (2). If desired, the said pressure ram (2) may also have lateral grooves for receiving the said rakes (11). FIG. 8 shows the resting position by solid lines, and the extended position on the right-hand side by broken lines.

The said frame (25) can be moved up and down together with the said rakes (12) in relation to the said pressure ram (2) via a lowering drive, not shown. The said piston rod (23) has corresponding, longitudinally and transversely extending recesses for accommodating the said, essentially cross-shaped frame (25).

The said rakes (11) arranged on the said two narrow sides (18) additionally have, at their two ends, longitudinally movable and pivotable tines, which act as said folding fingers (13). Corresponding pushing and pivoting drives (28, 29) are arranged for this purpose on the connection yoke (27) of the said rakes (11). The said drives (28, 29) preferably consist of hydraulic or pneumatic cylinders (30, 34).

FIGS. 9 and 10 illustrate the design of the said drives (28, 29), FIG. 9 showing the retracted position, and FIG. 10 showing the extended position.

The said folding fingers (13) are arranged at one end of bent straps (32), which are mounted rotatably around the vertical axis at the other end via a pivot bearing (34) on a carriage (31). The said rod-shaped carriages (31) in turn are arranged movably next to each other via suitable guides along the said narrow side (18) of the said pressure ram (2) in the said connection yoke (27). The said cylinder (30) of the said two pushing drives (28) for the said folding fingers (13) is arranged in the said connection yoke (27) and is mounted with its housing on one of the said carriages (31) (cf. FIG. 10). The end of its piston rod is connected via a bracket to the said other carriage (31). The said cylinder (30) pushes the said carriage (31) with the said straps (33) and the said folding fingers (13) in the outward direction, and again retracts them.

The said cylinders (34) of the said pivoting drive (29) for the said folding fingers (13) are guided within the said connection yoke (27) and are arranged on the associated carriage (31). They are extended and retracted with the said carriage (31). The piston rods of the said cylinders (34)are connected to the said bent straps (33) approximately in their middle. The said cylinders (34) are able to pivot the said folding fingers (13) by 90° from their starting position on the said narrow side (18) to the said broad side (19) of the said pressed bale (4) and back.

As is illustrated in FIG. 8, one horizontal carrier (35) each, which extends along the said broad side (19) of the said pressed bale (4), is arranged at the ends of the said carriages (31). The carrier 35 is guided movably on the said connection yoke (27) along the said narrow side (18). For clarity's sake, the said carrier (35) is represented only at one of the said extended carriages (31). The said carrier (35) is so long that it is located in the path of movement of the said adjacent rake (11). In addition, the said rakes (11) extend farther out than the said folding fingers (13). During the extension movement, the said two carriages (31) with the said carriers (35) strike a stop of the said adjacent rakes (11) on both sides. During the subsequent retracting movement of the said rakes (11), the said carriers (35) and the said folding fingers (13) are carried to the said broad side (19) of the said pressed bale (4). To achieve this, the pressure of the said cylinder (30) of the said pushing drive (28) can be released, and it does not offer any resistance to the retracting movement of the said carriages (31).

After the said press box (5) has been pulled off, the said upper folding device (8) starts to function. The said press box (5) has carried the said head film (6) in the upward direction and brought it into the position according to FIG. 6. The said four rakes (11) and the said folding fingers (13) with their said carriages (31) are now extended horizontally in the outward direction, until they slightly project over the edges of the said pressure ram (2) and the said pressed bale (4), respectively. The said head film (6) is now carried, and it spontaneously folds partially downward. The said rakes (11) and the said folding fingers (13) are subsequently lowered from the extended position along the lateral surfaces of the bale, and they fold down the said head film (6).

As soon as the said rakes (11) assume the lowered position shown in FIG. 7, they are again retracted horizontally toward the said pressed bale (4), while they wrap over the said head film (6). The retracting movement of the said four rakes (11) may take place simultaneously or consecutively. A fold (9) each is formed in the corners during the vertical and horizontal movements of the said rakes (11). The fold formation is preferably supported by the extending movement of the said folding fingers (13) along the said narrow side (18) of the said pressed bale (4). Thus, the said folding fingers (13) assume a stripping function and allow the said folds (9) to project along the said narrow sides 18.

The said folding fingers (13) and their said carriages (31) are carried during the horizontal pressing movement of the said rakes (11) toward the said broad side (19) of the said pressed bale. Due to the horizontal movement and the carrying, the said complete folding device (8) is automatically adjusted to the existing bale size and to the possible expansion of the bale. The said folding fingers (13) are subsequently pivoted by 90° to the said broad side (19). They now bend over the said projecting folds (9) and fold them over onto the said broad side (19). As in the exemplary embodiment described first, the said folds (9) now lie flat on the film web already placed on, and are temporarily held by the said folding fingers (13).

As was mentioned in the introduction, after the said cover films (6, 7) have been wrapped around, the belly band or middle film is placed with an overlap over the said cover films (6, 7) and over the said pins (16), the said tines (12), and the said folding finger (13). Strapping through the said strapping grooves (22), which have been left open, is subsequently performed. When packing of the said pressed bale (4) is now completed, the said rakes (11) together with the said folding fingers (13) are raised and pulled out of the said film package. The said pins (16) with the said folding fingers (13) at the bottom are lowered correspondingly as well. The said folds (9) are now secured in their positions by at least one strap band and are no longer able to leave their contact position in an uncontrolled manner on swelling of the said pressed bale (4).

The said rakes (11) are now moved back into their retracted starting position on the said pressure ram (2), and the said folding fingers (13) are also pivoted back and retracted. They are now ready for the next folding process. The said carriers (35) find place in the edge-side recesses of the said piston rod (23).

After ejection of the said completely packed pressed bale (4), the said press box (5) is also again lowered, and the said stripping frame (14) is thus again brought into the starting position at the said lower pressure ram (3). During the subsequent pivoting movement of the said yoke beam to the filling station, the said stripping frame (14) follows the movement of the said press box (5). A new bottom film (7) can optionally be placed in the final pressing station onto the said empty pressure ram (3), and the said stripping frame (14), which is subsequently lowered, will strip the said bottom film (7) downward at the edges around the said pressure ram (3). As an alternative, the said bottom film (7) can also be introduced, with the said stripping frame (14) lowered, into the gap between the said press box (5) and the said stripping frame (14), and be placed onto the said pressure ram (3). This can be carried out optionally in the final pressing station or in the filling station. As soon as the said stripping frame (14) is located under the said bottom film (7), this said folding device (8) is also ready again for the next wrapping process.

List of Reference Numerals

1. Baling press
2. Pressure ram, upper
3. Pressure ram, lower
4. Pressed bale, bale
5. Press box
6. Cover film, top, head film
7. Cover film, bottom, bottom film
8. Folding device
9. Fold
10. Folding frame
11. Rake
12. Tine
13. Folding finger
14. Stripping frame
15. Stripping opening
16. Pins
17. Strapping device
18. Narrow side
19. Broad side
20. Direction of movement
21. Bar, lifting bar
22. Strapping groove
23. Piston rod
24. Shoulder
25. Frame
26. Pushing drive, rake
27. Connection yoke
28. Pushing drive, folding finger
29. Pivoting drive, folding finger
30. Cylinder, pushing drive
31. Carriage
32. Pivot bearing
33. Strap
34. Cylinder, pivoting drive
35. Carrier

We claim:

1. A device for wrapping a cover film around a pressed bale on a baling press, the cover film being stretched between a pressure ram and the pressed bale, and placed on a lateral surface of the pressed bale, the device comprising:

folding means for forming laterally projecting folds in the cover film, said folding means including a folding frame means including a folding frame moveable along the pressed bale and including movement means for moving said folding frame, and movable folding finger means including folding fingers, said folding frame means for placing said cover film on said pressed bale to form said laterally projecting folds at corners of said bale, said folding finger means for folding said laterally projecting folds over and placing said laterally projecting folds on said pressed bale; and belly band application means for placing a belly band cover film laterally around said pressed bale, over said folds and over said folding fingers, said movement means for retracting said folding fingers after application of said belly band cover film, said belly band cover film extending substantially between a top and a bottom of said bale, over said lateral surfaces of said pressed bale and over said folds.

2. A device according to claim 1, wherein said folding frame means includes a stripping frame laterally surrounding said pressed bale, said stripping frame including laterally projecting strippings opening at corners to form said laterally extending folds.

3. A device according to claim 2, wherein said stripping openings extend along narrow sides of said pressed bale.

4. A device according to either claim 2 or claim 3, wherein said stripping frame is attached to an underside of a press box forming a part of said baling press.

5. A device according to either claim 2 or claim 3, wherein said folding fingers are positioned at corners of said pressed bale arranged adjacent said stripping frame, said stripping frame moving from a lower position to an upper position for moving portions of said cover film into contact with sides of said pressed bale and forming said folds, said folding fingers being movable in a same direction as said stripping frame for engaging said film portions and to position said folding fingers pivotably mounted along one side of said pressed bale.

6. A device according to either claim 2 or claim 3, further comprising a plurality of movable pins arranged adjacent said stripping frame and movable in a direction of movement of said stripping frame, said movable pins holding said cover film placed on the pressed bale.

7. A device according to claim 6, wherein two sides of said pressed bale, said folding fingers, and said pins are arranged on a common, vertically movable bar.

8. A device according to claim 1, wherein said folding frame is formed by a plurality of rakes, said rakes including tines located at spaced locations from one another, said plurality of rakes including two rakes with corner tines acting as said movable folding fingers of said folding means.

9. A device according to claim 8, wherein said folding fingers are connected to finger folding moving means for moving said folding fingers laterally along said pressed bale, and for pivoting said folding fingers around a corner of said pressed bale.

10. A device according to either claim 8 or claim 9, wherein said folding fingers are arranged on a narrow side of said pressed bale in a resting position.

11. A device according to either claim 8 or claim 9, further comprising: movable carriers connected to said rakes for movement of said rakes in any of three orthogonal directions, said carriers for supporting said folding fingers.

12. A device according to either claim 8 or claim 9, wherein said rakes are arranged at a pressure ram for lowered movement therewith.

13. A device according to claim 1, further comprising means for applying a strap band to said pressed bale for securing said folds in a folded position.

14. A process for covering a pressed bale on a baling press, comprising the steps of:

stretching a bottom cover film between a lower pressure ram and the pressed bale;

providing a stripping frame below said the bottom cover film, said stripping frame having internal surfaces for laterally surrounding said pressed bale and having fold forming surfaces;

moving said stripping frame upwardly to position portions of said cover film in contact with said lateral surfaces of said bale and to form laterally projecting folds of said bottom cover film;

providing pins below said bottom cover film, said pins extending in parallel to said lateral surfaces and moving said pins upwardly to maintain said bottom cover film in contact with said lateral surfaces;

positioning folding fingers at corners of said bale and contacting said laterally projecting folds to place said laterally projecting folds on said pressed bale;

stretching a head cover film between an upper pressure ram and said pressed bale;

providing rakes with tines, above said head cover film, said tines extending downwardly in parallel to said lateral surfaces and moving said tines downwardly to move portions of said head cover film into contact with said lateral surfaces of said pressed bale and to form outwardly extending folds, extending outwardly from said pressed bale;

providing additional folding fingers at corners of said pressed bale and moving said outwardly extending folds to place said outwardly extending folds in contact with said pressed bale;

wrapping a belly band cover film around said lateral surfaces of said pressed bale, said belly band cover film extending substantially between said top and bottom of said bale, over said lateral surfaces of said pressed bale, over said folds of said head cover film and said bottom cover film and over said folding fingers and additional folding fingers while said folding fingers and additional folding fingers are holding said folds to said pressed bail;

and then removing said pins and folding fingers and removing said rake tines and additional folding fingers and subsequently applying a strap band around said bale covered with said head cover film, said bottom cover film and said belly band cover film.

15. A process for covering a pressed bale on a baling press, comprising the steps of:

stretching a bottom cover film between a lower pressure ram and the pressed bale;

providing a folding frame;

moving said folding frame to position portions of said bottom cover film in contact with said lateral surfaces of said bale and to form laterally projecting folds of said bottom cover film, and to maintain said bottom cover film in contact with said lateral surfaces;

positioning folding fingers at corners of said bale and contacting said laterally projecting folds to place said laterally projecting folds on said pressed bale;

stretching a head cover film between an upper pressure ram and said pressed bale;

providing a second folding frame and moving said second folding frame to move said head cover film into contact with said lateral surfaces of said pressed bale and to form outwardly extending folds, extending outwardly from said pressed bale;

providing additional folding fingers at corners of said pressed bale and moving said outwardly extending folds to place said outwardly extending folds in contact with said pressed bale;

wrapping a belly band cover film around said lateral surfaces, said belly band cover film extending substantially between said top and bottom of said bale, over said lateral surfaces of said pressed bale, over said folds of said head cover film and said bottom cover film and over said folding fingers and additional folding fingers while said folding fingers and additional folding fingers are holding said folds to said pressed bail;

and then removing said folding fingers and removing said additional folding fingers.

* * * * *